United States Patent [19]

O'Brien

[11] Patent Number: 5,071,167

[45] Date of Patent: Dec. 10, 1991

[54] SHIPPING AND RETURN MAILING LABEL

[75] Inventor: Sean R. O'Brien, Glen Ellyn, Ill.

[73] Assignee: Avery International, Pasadena, Calif.

[21] Appl. No.: 558,665

[22] Filed: Jul. 27, 1990

[51] Int. Cl.[5] ..... B42D 15/00

[52] U.S. Cl. ..... 283/79; 283/81; 283/80; 283/62

[58] Field of Search ..... 283/62, 79, 80, 81, 283/117

[56] References Cited

U.S. PATENT DOCUMENTS

| | | | |
|---|---|---|---|
| 4,110,502 | 8/1978 | Baer | 283/81 X |
| 4,272,327 | 6/1981 | Logan | 283/81 X |
| 4,598,935 | 7/1986 | Stewart | 283/81 |
| 4,708,368 | 11/1987 | Instance | 283/81 |
| 4,927,179 | 5/1990 | Ehret et al. | 283/81 X |
| 4,955,640 | 9/1990 | Anderson | 283/81 X |

*Primary Examiner*—Paul A. Bell

*Attorney, Agent, or Firm*—Poms, Smith, Lande & Rose

[57] ABSTRACT

A shipping and return mailing label includes three parts: (1) a shipping label, (2) a return label, and (3) an intermediate card connected to the two labels by lines of perforations, with the front face of all the parts of the label assembly being exposed as the label assembly is mounted on a backing sheet, so that, for example, bar codes may be directly printed on each of the three parts. The return label is coated with adhesive on its rear side, the card may be free of adhesive, and the shipping label may be of greater extent than the return label and the card, and may have stripes of adhesive located on its three free edges, so that the entire assembly, following printing, may be folded in a Z-shaped manner, and secured to a carton to be shipped. Following receipt of the carton, the customer may remove the shipping label along perforation lines which are provided, and have access to the card for instructions, or to use it as a return postcard, thereby exposing the return label, so that the goods may be shipped back to the original shipper, if desired.

19 Claims, 3 Drawing Sheets

FIG. 1
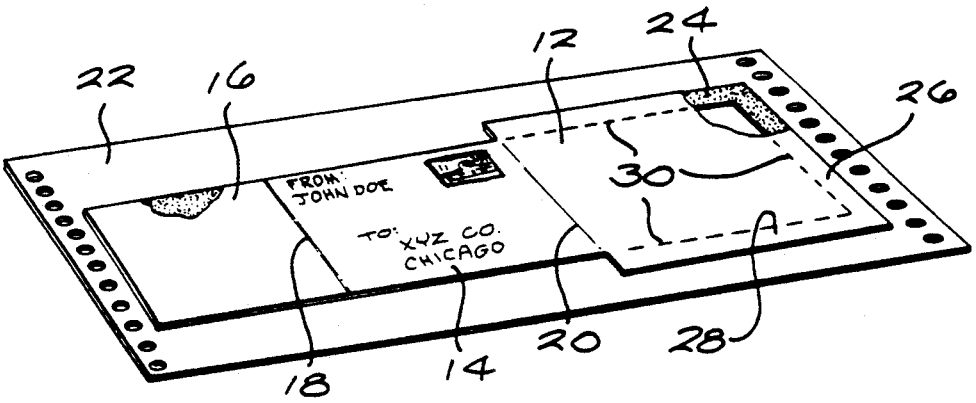
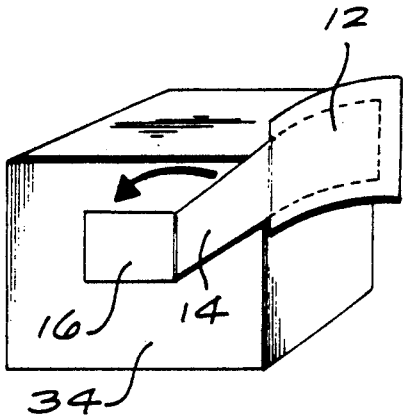
FIG. 2
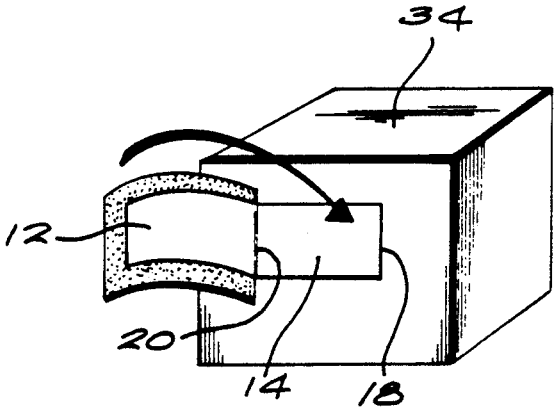
FIG. 3
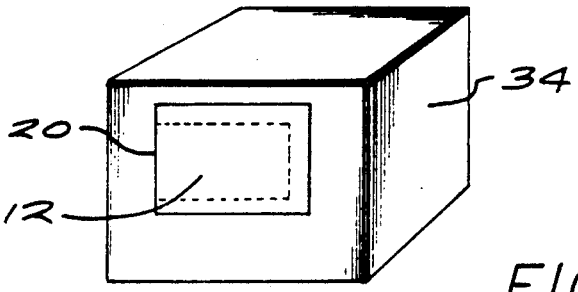
FIG. 4

SHIPPING AND RETURN MAILING LABEL

FIELD OF THE INVENTION

This invention relates to special Shipping and Return Mailing Labels, which may also include additional printed information such as instructions, or a return postcard.

BACKGROUND OF THE INVENTION

It has previously been proposed to use multiple layer forms for shipping and return mailing labels, with a return postcard in an intermediate layer. However, when bar code information is to be applied to more than one of the laminates, it was found that bar codes are not easily or accurately imprinted through carbons or NCR type multiple copy processes.

Accordingly, a principal object of the present invention is to provide a multiple shipping and return label assembly, with an included card for instructions or a return postcard, which is simple and convenient to use, and wherein the bar code information may be directly imprinted on the multiple parts of the assembly.

SUMMARY OF THE INVENTION

In accordance with an illustrative embodiment of the invention, a single sheet of card stock is formed into a shipping label, a return label, and an additional card mounted between the two labels and having perforations between the card and the labels, are mounted on a backing sheet with their front surfaces exposed to directly receive printed information which may include a bar code and address information. The return label may be coated with pressure-sensitive adhesive, and the mailing label is slightly greater in extent than the card and the return label, and has adhesive on its free edge and the upper and lower extending edges; so that following imprinting, the label may be removed from the backing sheet and Z-folded to form a three-layer laminate with the mailing label exposed, the card in the middle, and the return label underneath.

In accordance with other collateral aspects of the invention:

(1) the return label may be fully coated with pressure-sensitive adhesive;

(2) the assembly may be formed of 7 to 10 point card stock, 0.007 to 0.010 inch thick;

(3) the backing sheet may be a continuous sheet with pin holes for feeding or advancing the label assemblies; or the backing sheet(s) could be adapted for feeding through a laser printer;

(4) the card may be a return postcard or may contain other information, relating to returns, for example:

(5) the three parts of the label assembly may each be imprinted with bar codes; and (6) the mailing label may be provided with perforations along three edges thereof, immediately inside the peripheral adhesive, to facilitate access to the card, and exposure of the mailing label.

In accordance with another aspect of the invention, a multiple layer label assembly includes a first label having pressure-sensitive adhesive on the rear surface thereof; an intermediate sheet secured by a line of perforations to the first label; and a second label secured by a line of perforations to the intermediate sheet, with the second label being of greater height and length than both the first label and the intermediate sheet, and having stripes of pressure-sensitive adhesive along the free edges thereof on the back side thereof. Information may be directly printed on the front of the two labels and the intermediate sheet. The two labels may be Z-folded to form a three-layer laminate with the first label directly adhered to the surface, the intermediate sheet being above the first label, and the second label on top secured to the surface by the stripes of adhesive, and completely covering and enclosing the intermediate sheet.

Other objects, features, and advantages of the invention will become apparent from a consideration of the following detailed description and the accompanying drawings.

BRIEF DESCRIPTION OF THE DRAWINGS

FIG. 1 is a schematic showing of a label assembly illustrating the principles of the present invention;

FIG. 2 shows the first step in the application of the label assembly shown in FIG. 1 to a carton for shipping;

FIG. 3 shows the second step in the application of the label assembly to the carton, with the intermediate card being folded over the return label;

FIG. 4 shows the final step in the application of the label assembly to the carton, with the mailing label being folded over the card and the return label, and being secured by adhesive stripes extending along the three edges of the outer shipping label;

DETAILED DESCRIPTION OF PREFERRED EMBODIMENTS

Figure 5:
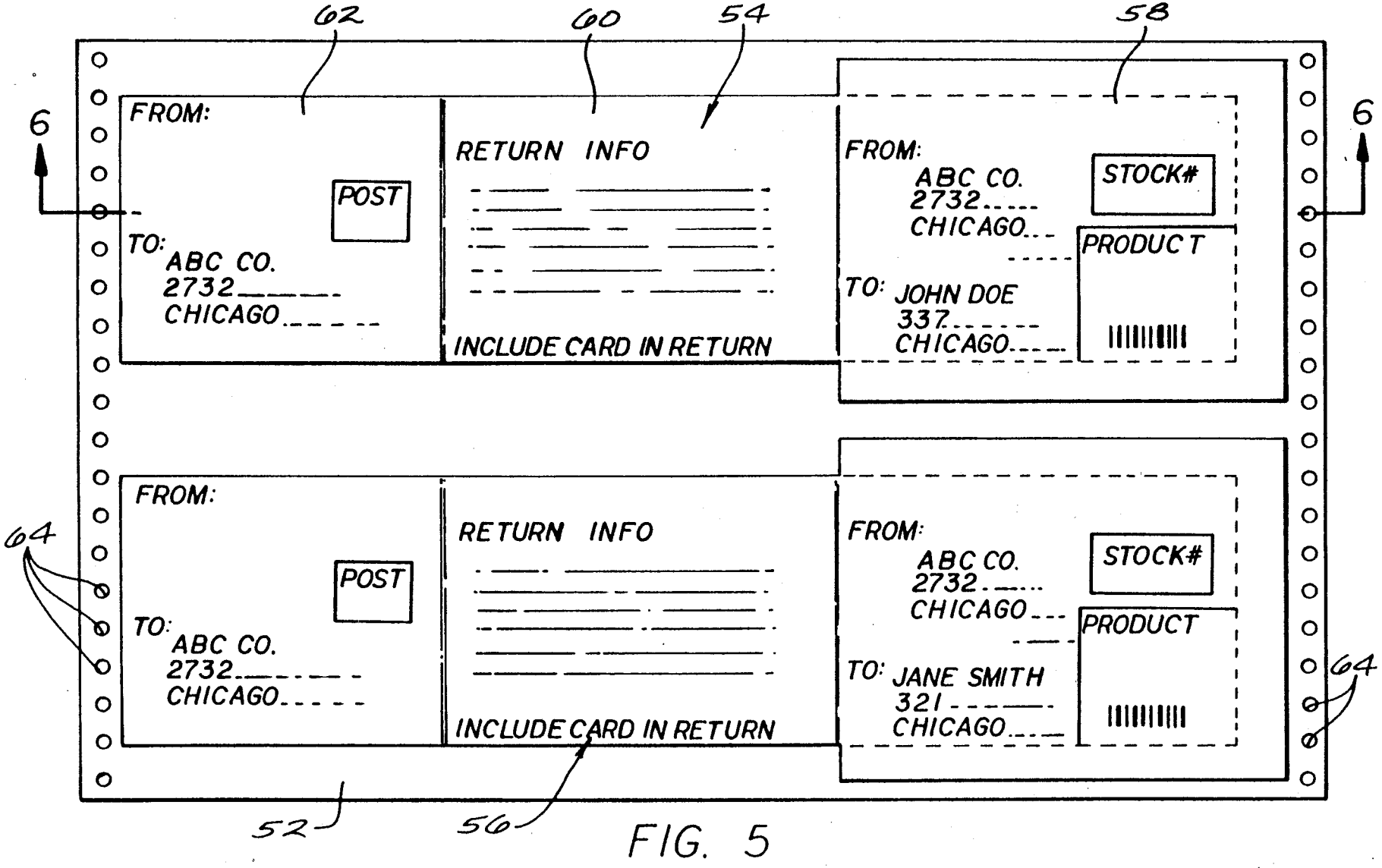
FIG. 5 shows two representative label assemblies and the backing sheet upon which the label assemblies are affixed or mounted.

Referring more particularly to the drawings, FIG. 1 is a schematic perspective view of a label illustrating the principles of the present invention. More particularly, the assembly of FIG. 1 includes a label 12 for shipping a product, such as a carton, to customers, a card 14 which may be a return postcard, or a card giving merchandise return information, and a return mailing label 16 which may be employed to return the carton package to the shipper. The three portions of the label assembly, 12, 14, and 16, are separated from one another by perforation lines 18 and 20. The entire assembly is mounted on a backing sheet 22, which may be provided with the usual release coating, so that the label assembly, including parts 12, 14, and 16, will only lightly adhere to the backing sheet, and will not be permanently secured thereto.

The return label 16 may have a full coating of pressure-sensitive adhesive on its lower surface, facing the backing sheet 20. The card 14 has no adhesive on either surface thereof. The shipping label 12 is of slightly greater extent than the label 16 and the card 14, and has adhesive along its three free edges, as indicated at reference numeral 24, 26, and 28. The portion of the shipping label which is coated with adhesive, is separated from the remainder of the shipping label by the perforations 30. Incidentally, in FIG. 1 the size of the shipping label 12 is not to scale, as it should have somewhat greater width than is shown, so that when folded, it will cover the folded combination of portions 14 and 16 of the assembly, as shown hereinbelow.

FIG. 2 illustrates the first step in applying the label assembly 12, 14, 16 to a carton 34 which is to be shipped. First, the label assembly is peeled off from the backing sheet 22 and the return label 16 is firmly adhered to the carton 34 in view of the layer of pressure-sensitive adhesive on the back thereof. Next, the card 14 is folded over along the perforations 18, with basic shipping label 12 not yet in engagement with the carton 34. Then, as shown in FIG. 4, the shipping label 12 is folded across the card 14 and the underlying label 16, along perforations 20, and the three overlapping edges of the label 12 are adhered to the carton 34 by pressing the three stripes of adhesive located on the free edges of the shipping label 12 against the carton 34.

FIG. 5 shows a complete assembly including a backing sheet 52 with two label assemblies 54 and 56 secured thereto. The label assembly 54 includes the shipping label 58, the information card 60, and the return label 62. Label assembly 54 is adhered to the backing sheet by a full coating of adhesive on the back of the return label 62, and by the stripes of adhesive along the edges of the shipping label 58 as it would extend beyond the card 60 and the return label 62, when applied to a surface in the manner shown in FIG. 4. Similarly, the label assembly 56 has three similar sections, and adhesive located in the corresponding places. Further, the two label assemblies have lines of perforations in the locations discussed hereinabove in connection with FIG. 1 of the drawings.

Figure 6:
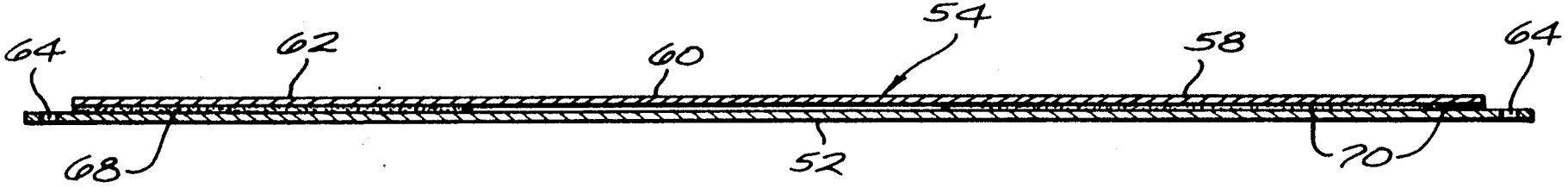
FIG. 6 is a cross-sectional view to a reduced scale, taken along lines 6—6 of FIG. 5.

FIG. 6 of the drawings is a schematic cross-sectional view taken along line 6—6 of FIG. 5. Incidentally, FIG. 6 is drawn to one-half the scale of FIG. 5. More specifically, FIG. 6 shows the label assembly 54 mounted on the backing sheet 52, with the pin holes 64 being visible on the portions of the backing sheet 52 which extend beyond the ends of the label assembly 54. The coating of adhesive 68 between the return label 62 and the backing sheet 64 is shown schematically in FIG. 6, with the thickness the adhesive, as well as the thickness of the label assembly and the backing sheet being greater than they would be in actuality, if FIG. 6 were drawn to scale. It may also be noted that the stripe of adhesive 70 along the extreme outer edge of the shipping label 58 is shown in FIG. 6. Although a space is shown between the card 54 and the backing sheet 52, in actuality, because the adhesive layers are so thin, the card 54 would probably actually rest against the backing sheet 52.

Figure 7:
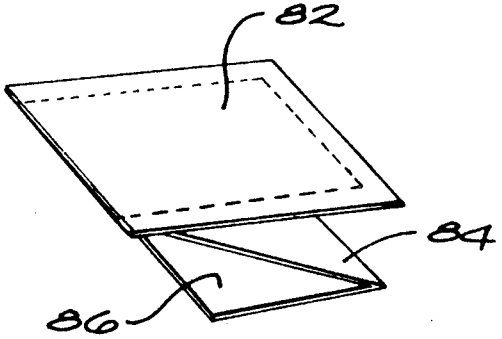
FIG. 7 shows the Z-shaped configuration of the label assembly as it is removed from the backing sheet and is about to be applied to the carton or other surface.

FIG. 7 shows schematically the Z-shaped configuration of the label assembly after it has been removed from the backing sheet, and before it has been applied to the carton. More specifically, with reference to FIG. 7, it shows the shipping label 82, the intermediate card 84, and the underlying return address label 86. The angled line in FIG. 7 indicates schematically that the lowermost surface of the return label 86 is coated with pressure-sensitive adhesive, either continuously, or with a substantial portion of its surface being covered with pressure-sensitive adhesive; and the lower surfaces of the three free edges of the shipping label 82 which extend beyond the card 84 and the label 86 also coated with stripes of pressure-sensitive adhesive.

Figure 8:
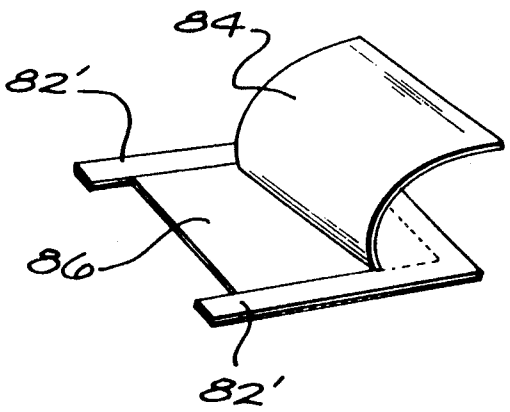
FIG. 8 shows the step of removing the intermediate card, following removal of the perforated section of the shipping label, leaving the return label exposed.

FIG. 8 shows the return label 86, and the residual edges of the shipping label 82, designated 82', after the main part of the shipping label has been removed along the perforations, and the card 84 which is in the process of being removed from its connection to the underlying return label, along the line of perforations which interconnect these two portions of the shipping assembly.

In conclusion, it is to be understood that the foregoing detailed description and the accompanying drawings relate to preferred illustrative embodiments of the invention. In this regard, it is noted that an intermediate return postcard is shown in FIG. 1, while instructions or information for returning merchandise is included on the intermediate card, in the embodiment of FIG. 5. Various changes and modifications may be made in the disclosed embodiments without departing from the spirit and scope of the invention. Thus, by way of example and not of limitation, instead of using card stock which is in the order of seven to ten points in weight, or about 0.007 to 0.010 inch in thickness, somewhat lighter or heavier stock could be employed. Concerning the backing sheet material, instead of a continuous pin feed backing sheet, individual or continuous sheets suitable for laser printing may be employed. In addition, instead of using full adhesive coverage on the bottom of the return label and on the stripes around the edges of the shipping label, these pressure-sensitive adhesive areas could be provided with lines or closely spaced dots of adhesive for accomplishing substantially the same result. In addition, the multiple layer label could be employed for other purposes, such as for providing a game piece or coupon, located between the upper and lower labels. Accordingly, the present invention is not limited to the precise embodiments shown in the drawings and as described hereinabove.

What is claimed is:

1. A multiple layer label assembly comprising:

a first label having pressure-sensitive adhesive on the back surface thereof;

an intermediate sheet secured by a line of perforations to said first label;

a second label secured by a line of perforations to said intermediate sheet, said second label being of greater height and length than said intermediate sheet and said first label and having stripes of pressure-sensitive adhesive extending along the upper and lower edges and the free end, thereof, on the rear side thereof; and printed information on the front side of said first label, said second label and said intermediate sheet;

whereby said two labels and said intermediate sheet may be folded along said lines of perforations and applied to a surface, with the first label fully and directly adhered to the surface, with the second label exposed, and the intermediate sheet mounted between the two labels.

2. A label assembly as defined in claim 1 wherein said pressure-sensitive adhesive is permanent pressure-sensitive adhesive.

3. A label assembly as defined in claim 1 wherein said return label has a full coating of adhesive extending over the entire rear surface thereof.

4. A label assembly as defined in claim 1 wherein perforations are provided along three edges of said label immediately within the adhesive.

5. A multiple layer label assembly comprising:

a first label having a coating of pressure-sensitive adhesive on the back surface thereof;

an intermediate sheet secured by a line of perforations to said first label;

a second label secured by a line of perforations to said intermediate sheet, said second label being of greater height and length than said intermediate sheet and said first label and having strips of pressure-sensitive adhesive extending along the upper and lower edges and the free end, thereof, on the rear side thereof;

printed information on the front side of said first label, said second label and said intermediate sheet;

a backing sheet having a release coating thereon; and said first and second labels and said intermediate sheet being mounted on said backing sheet by the pressure-sensitive adhesive with the front of said labels and said sheet all exposed so that the information may be printed on said shipping and return labels and on said sheet while they are mounted on said backing sheet;

whereby said two labels and said intermediate sheet may be folded along said lines of perforations and applied to a surface, with the first label fully and directly adhered to the surface, with the second label exposed, and the intermediate sheet mounted between the two labels.

6. A label assembly as defined in claim 5 wherein said backing sheet is a continuous sheet provided with pin holes on the edges thereof for feeding the sheet.

7. A label assembly as defined in claim 5 wherein said labels and said intermediate sheet are formed of 7 to 10 point card stock.

8. A label assembly as defined in claim 7 further comprising a backing sheet supporting said two labels and said intermediate sheet side-by-side with one surface of each of said labels and said intermediate sheet being exposed to receive printing.

9. A label assembly as defined in claim 5 wherein said pressure-sensitive adhesive is a permanent pressure-sensitive adhesive.

10. A label assembly as defined in claim 5 wherein said two labels and said intermediate sheet each have a bar code printed thereon.

11. A label assembly as defined in claim 6 wherein perforations are provided along three edges of said second label immediately within said stripes of adhesive.

12. A shipping and return mailing label assembly comprising:

a return label providing return address information on the face thereof and having a coating of pressure-sensitive adhesive on the back surface thereof;

an intermediate card secured by a line of perforations to said return label;

a shipping label secured by a line of perforations to said card, said shipping label being of greater height and length than said card and said return label and having stripes of pressure-sensitive adhesive extending along the upper and lower edges and the free end, thereof, on the rear side thereof, with the front thereof bearing shipping address information;

bar code information on the front side of said shipping label, said return label and said card;

a backing sheet having a release coating thereon; and said shipping and return labels and said card being mounted on said backing sheet by the pressure-sensitive adhesive with the front of said labels and said card all exposed so that the bar codes may be printed on said shipping and return labels and on said card while they are mounted on said backing sheet;

whereby said two labels and said card may be folded along said two lines of perforations and applied to a package to be shipped with the return label against the package, said shipping label exposed and on top, and said card between the labels.

13. A label assembly as defined in claim 1 wherein said backing sheet is a continuous sheet provided with pin holes on the edges thereof for feeding the sheet.

14. A label assembly as defined in claim 12 wherein said labels and said card are formed of 7 to 10 point card stock.

15. A label assembly as defined in claim 12 wherein said pressure-sensitive adhesive is a permanent pressure-sensitive adhesive.

16. A label assembly as defined in claim 12 wherein said return label has a full coating of adhesive extending over the entire rear surface thereof.

17. A label assembly as defined in claim 12 wherein perforations are provided along three edges of said shipping label immediately within said stripes of adhesive.

18. A label assembly as defined in claim 12 wherein said card is a return postcard.

19. A label assembly as defined in claim 12 wherein said card bears merchandise return information.

* * * * *